US006078319A

United States Patent [19]

Bril et al.

[11] Patent Number: 6,078,319

[45] Date of Patent: Jun. 20, 2000

[54] PROGRAMMABLE CORE-VOLTAGE SOLUTION FOR A VIDEO CONTROLLER

[75] Inventors: Vlad Bril, Campbell; Sagar Waman Kenkare, Fremont; Thomas Shieh-Luen Ho, Santa Clara; Edmund Christian Strauss, San Jose, all of Calif.

[73] Assignee: Cirrus Logic, Inc., Fremont, Calif.

[21] Appl. No.: 08/423,251

[22] Filed: Apr. 17, 1995

[51] Int. Cl.[7] ..... G09G 5/00

[52] U.S. Cl. ..... 345/211; 345/212; 345/132

[58] Field of Search ..... 365/226; 327/530; 326/81, 68, 121; 345/132, 204, 211, 212, 112, 3, 507, 196; 364/707; 395/750.03, 750.04, 750.05, 285

[56] References Cited

U.S. PATENT DOCUMENTS

| | | | |
|---|---|---|---|
| 4,308,532 | 12/1981 | Murphy | 345/132 |
| 4,853,560 | 8/1989 | Iwamura et al. | 326/296.1 |
| 5,086,295 | 2/1992 | Boettcher et al. | 345/132 |
| 5,300,835 | 4/1994 | Assar et al. | 326/68 |
| 5,394,028 | 2/1995 | Feddeler et al. | 327/544 |
| 5,444,663 | 8/1995 | Furuno et al. | 365/226 |
| 5,524,249 | 6/1996 | Suboh | 395/750.04 |
| 5,532,717 | 7/1996 | Jones et al. | 345/132 |
| 5,559,966 | 9/1996 | Cho et al. | 395/285 |
| 5,578,957 | 11/1996 | Erhart et al. | 345/208 |
| 5,594,360 | 1/1997 | Wojciechowski | 324/771 |
| 5,608,864 | 3/1997 | Bindlish et al. | 345/507 |
| 5,611,041 | 3/1997 | Bril et al. | 345/507 |
| 5,694,143 | 12/1997 | Fielder et al. | 345/112 |

*Primary Examiner*—Richard A. Hjerpe
*Assistant Examiner*—Francis N. Nguyen
*Attorney, Agent, or Firm*—Robert P. Bell; Steven A. Shaw

[57] ABSTRACT

An integrated circuit such as a video controller may be provided with core logic circuitry using CMOS technology which may be operated at different supply voltages such as 3.3 or 5 Volts. At lower supply voltages, the CMOS circuitry may run slower. For a video controller, certain higher resolution, pixel depths, and refresh rates may require high speed operation of the video controller. A monitoring circuit monitors the video mode, pixel resolution, pixel depth, and refresh rate and determines which supply voltage may be used to operate the video controller at such levels. An output signal from the monitoring circuit may be used by a switching circuit to supply an appropriate supply voltage to the integrated circuit. At lower performance levels, the integrated circuit may be operated at lower voltages to conserve power.

11 Claims, 3 Drawing Sheets

PROGRAMMABLE CORE-VOLTAGE SOLUTION FOR A VIDEO CONTROLLER

FIELD OF THE INVENTION

The present invention concerns power supply control circuitry for reducing power consumption in an integrated circuit, particularly for a video controller such as a VGA controller.

BACKGROUND OF THE INVENTION

Different supply voltages ($V_{DD}$) have been used in computer systems to accommodate different types of transistor technologies of the logic circuit comprising the computer. The popularity of portable battery powered computers has created a need for lower system operating voltages and corresponding reductions in power consumption. CMOS transistor technology may operate at various voltage levels, for example, 5 Volts or 3.3 Volts. However, at lower voltage levels, the speed and performance of CMOS logic circuits may be degraded. Typically, a CMOS circuit may be only 70% as fast when supply voltage $V_{DD}$ is set at 3.3 Volts versus 5 Volts.

For a video controller integrated circuit (IC), such as a VGA controller IC, it may be desirable to operate the IC at a lower supply voltage $V_{DD}$ in order to reduce power consumption, for example, when applied to a laptop or notebook computer. In addition, with the advent of low power consumption desktop computers and the like, it may be desirable to operate circuitry within a personal computer (PC) at a lower operating voltage if possible.

For a video controller IC, however, performance limitations may prevent the IC from being operated at a low voltage. For example, a VGA controller IC may be required to support one or more pixel resolutions, such as 640×480, 800×600, or 1024×768, a number of pixel depths, such as 8, 16, or 24 bits per pixel (BPP), and a number of refresh rates, such as 60 Hz, 72 Hz or 75 Hz. A video controller operating at a lower supply voltage $V_{DD}$ (e.g., 3.3 volts) may be able to operate at a memory clock speed sufficient to provide adequate data bandwidth to support lower resolution displays at lower refresh rates (e.g., 640×480 @ 8 BPP resolution at 60 Hz) but may not have enough data bandwidth due to reduced MCLK frequency to support higher resolutions at higher refresh rates (e.g., 800×600 @ 16 BPP @ 75 Hz). The maximum memory clock frequency at 3.3 Volts may not allow enough memory bandwidth for the controller to support higher resolution modes.

One solution to such a problem is to configure an IC such as a video controller IC to operate at a predetermined voltage such that the highest contemplated resolution (i.e., required data bandwidth) is supported by that predetermined voltage. While such a technique may insure that the IC will operate in desired video modes, power savings are not maximized when the IC is operating in lower resolution modes. For example, if an IC is configured to operate at 5 Volts to support 1024×768 pixel resolution, potential power savings may be lost if the IC is operated at lower resolutions (e.g., 640×480) for substantial periods of time.

SUMMARY AND OBJECTS OF THE INVENTION

A video controller integrated circuit comprises a core circuitry receiving video data from a video memory and processing the video data to produce video output data and receiving a signal indicative of at least a resolution and a pixel depth for the video data. An output circuit receives the video output data and generates a video output signal. The output circuit is supplied with a first power supply voltage.

A logic circuit coupled to the core circuitry, receives the resolution and pixel depth signal and outputs a logical level signal indicative of a supply voltage sufficient to drive said core circuitry. A switching means, coupled to the logic circuitry and the core circuitry, receives the logic level signal, the first supply voltage, and a second supply voltage and outputs a power supply voltage to the core circuitry in response to the logic level signal.

It is an object therefor to switch from a first supply voltage to a second supply voltage in response to performance demands of an integrated circuit.

It is a further object of the present invention to output a voltage selection signal in response to performance demands of an integrated circuit.

It is a further object of the present invention to output a voltage selection signal in response to different pixel resolutions or video modes in a video controller circuit.

It is a further object of the present invention to reduce power consumption in an integrated circuit.

BRIEF DESCRIPTIONS OF THE DRAWINGS

Figure 1:
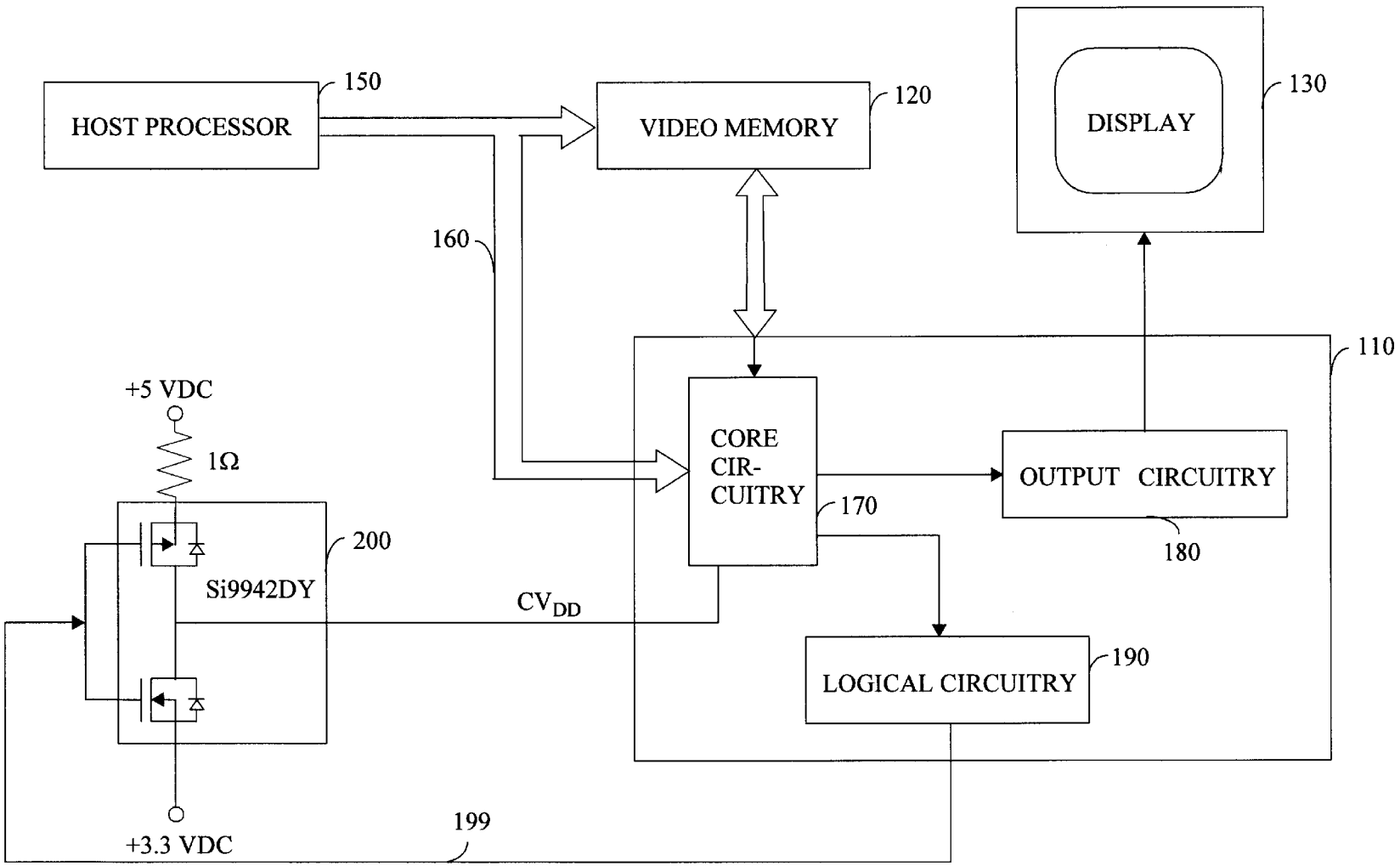
FIG. 1 is a block diagram illustrating a preferred embodiment of the present invention.
Figure 3:
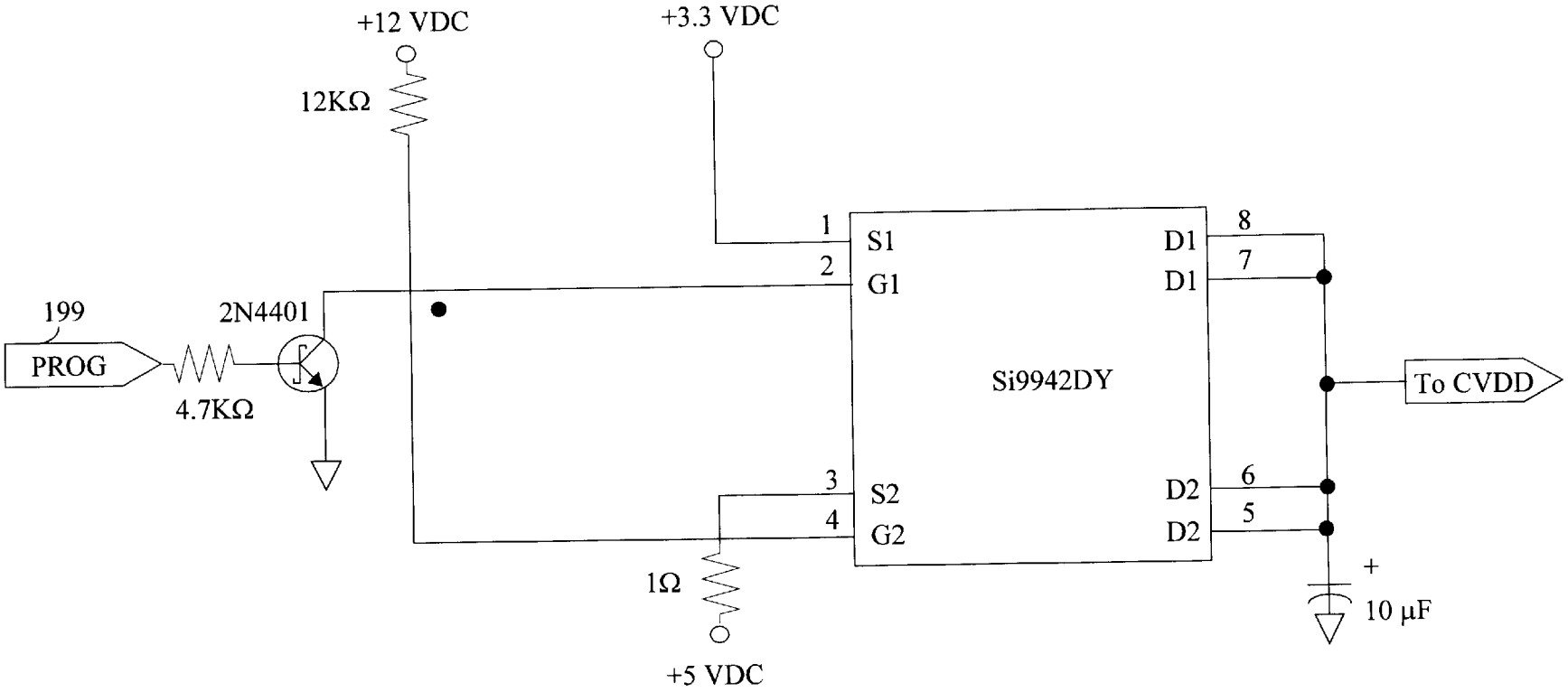

FIG. 3 schematic of a preferred embodiment of the switching circuit of FIG. 1.

DETAILED DESCRIPTION OF THE INVENTION

The present invention provides a technique for programmably altering the supply voltage of core circuitry of an IC in response to different processing speed requirements of the IC. In the preferred embodiment, the IC may comprise a video controller IC, for example, a VGA controller IC. In the preferred embodiment, the speed of the IC may refer to the memory clock frequency of the video controller IC.

FIG. 1 illustrates a first embodiment of the present invention. Video controller IC 110 may be provided coupled to video memory 120. Video memory 120 may be periodically refreshed with video data (e.g. text or graphics) by host processor 150 through system data bus 160. Video controller IC 110 retrieves video data from video memory 120, and converts the data into a video output signal suitable for driving a flat panel video display or CRT display 130. The operation of such VGA controllers is described, for example in *Programmer's Guide to the EGA and VGA Cards* by Richard F. Ferraro (©1990 Addison-Wesley Publishing Company) incorporated herein by reference.

Video Controller IC 110 may comprise a number of internal circuits including core circuitry 170 and output circuitry 180. Core circuitry 170 may comprise core logic circuitry of video controller IC 110. In addition, core circuitry 170 may further comprise a look-up table (LUT) or the RAM portion of a RAMDAC for a video controller.

Core circuitry 170 may retrieve video data from video memory 120 and convert the video data into output data. For example, for text data, core circuitry may convert ASCII data, attribute data and font bit map data into a digital output signal representing scan lines of a video display. For graphics data, core circuitry may convert video data in a first pixel format (e.g., 8 BPP) into a second pixel format (e.g., 16 BPP) using a look up table (LUT) as a palette. In general, core circuitry 170 may comprise digital logic circuitry such as CMOS circuitry. Such CMOS logic circuitry may be driven at various supply voltages $V_{DD}$ (e.g., 3.3 Volts or 5 Volts) as will be discussed below.

Output circuitry may be configured to interface with display 130 to produce an output signal. For example, for a CRT output, output circuitry may comprise a plurality of digital to analog converters (DACs) to generate analog RGB signals for a CRT display (e.g., VGA monitor) as well as corresponding sync signals. As display 130 requires output signal at a predetermined specification level, output circuitry generally may be driven at a fixed supply voltage such as 5 VDC as illustrated in FIG. 1.

In order to refresh display 130, video controller IC 110 may retrieve video data from video memory 120 at a sufficient rate to supply display 130 with a continuous video signal. At higher pixel resolutions and pixel depths (i.e., bits per pixel or BPP), a higher data bandwidth may be required in order to retrieve video data from video memory 120 fast enough to supply display 130. Thus, the video memory data bandwidth (i.e., clock speed for a given data width) must be sufficient to provide display 130 with a video signal.

Video memory bandwidth may also be affected by refresh rate of display 130 which may typically vary from 60 Hz to 75 Hz, depending upon display type. However, the effect of refresh rate on data bandwidth requirements may be substantially less than pixel resolution or depth. For example. The data bandwidth required to display a 16 BPP display at a particular resolution is twice that for an 8 BPP display at the same resolution. Similarly, the memory bandwidth required for a 1024×768 pixel resolution display at a particular pixel depth is more than twice that for a 640×480 pixel resolution display at the same pixel depth. In contrast, the increase in memory bandwidth for a 75 Hz refresh as compared to a 60 Hz refresh rate is approximately 25%.

For a particular video controller, different memory clock speeds may be required to provide required data bandwidth. Memory clock speed may be set internally in video controller IC 110 using an internal clock synthesizer. Table I illustrates examples of pixel resolutions, depths, and refresh rates which may be driven at particular memory clock (MCLK) speeds for the Cirrus Logic CL-GD754X video controller IC. The minimum clock frequencies for each resolution for the CL-GD754X have been determined by calculation and experimentation such that the video mode may be supported at the MCLK frequency. These examples are shown here for the purposes of illustration to assist in the understanding of the invention and are in no way intended to limit the scope of the present invention.

TABLE I

| MCLK = 50 MHz | | | MCLK = 40 MHz | | |
|---|---|---|---|---|---|
| Resolution | Depth | Refresh | Resolution | Depth | Refresh |
| 1024 × 768 @ | 8 BPP @ | 60 Hz | 800 × 600 @ | 8 BPP @ | 75 Hz |
| 800 × 600 @ | 16 BPP @ | 60 Hz | 640 × 480 @ | 8 BPP @ | 75 Hz |
| 640 × 480 @ | 24 BPP @ | 60 Hz | 640 × 480 @ | 16 BPP @ | 75 Hz |

Note that at a 40 MHz MCLK frequency, resolutions such as 640×480 at 24 BPP and 50 HZ, 800×600 16 BPP at 60 Hz, and 1024×768 at 8 BPP at 60 Hz may not run due to memory bandwidth limitations where the video memory comprises a 32 bit wide DRAM with a page cycle comprising 2 MCLK cycles and a random access cycle comprising 7 or 6 MCLK cycles. However sufficient memory bandwidth may be available to run these same resolutions at a 50 MHz MCLK frequency. Operating at a 50 MHz MCLK clock frequency, however, may require a higher operating voltage (e.g., 5 volts or the like).

Running at 16 bits per pixel (BPP) may require twice the memory bandwidth than 8 bits per pixel, as twice as many bits are required to refresh a screen of a given resolution. Similarly, a 75 Hz refresh rate may require 25% more bandwidth than a 60 Hz refresh rate, as the data rate required to refresh the screen must be increased 25%. The breakdown of resolution, pixel depth, and refresh rate versus clock frequency may vary from one controller design to another. Thus, the illustration of Table I is provided for the purposes of illustration only and is not intended to limit the present invention in any way.

Note that higher resolutions, pixels depths, and refresh rates generally require higher MCLK frequencies, as these video modes require a higher overall data bandwidth. For other types of video controllers, the breakdown of frequency versus resolution and pixel depth may differ. Also note that future video controllers may provide other (e.g., higher) resolutions and pixel depths which may require different (e.g., higher) MCLK frequencies. However, the overall inventive concept of the present invention may be applied to such a video controller regardless of the particular MCLK frequencies or resolutions involved.

To operate MCLK at 50 MHz, both the core and analog $V_{DD}$ in video controller IC 110 may be set for 5 Volts. However, to operate at 40 or 45 Mhz MCLK, core $V_{DD}$ may be set at 3.3 Volts to minimize power consumption. Core circuitry 170 may comprise CMOS circuitry which may run only 70% as fast at 3.3 Volts as at 5 Volts. Video controller IC 110 may be provided with logical circuit 190 to output a logic signal 199. Logical circuit 190 may contain a register bit for storing a logic signal bit. Such a register may be read out through I/O channels of video controller IC 110. Alternatively, a dedicated output pin may be provided to output logic signal 199.

Logical circuit 190 may be provided with a look up table or the like storing a predetermined schedule of pixel resolutions and depths (i.e., video modes) corresponding to particular MCLK frequencies or supply voltages, for example, as set forth in Table I above. Alternately, logical circuit 190 may provide voltage output signal in response to a MCLK request signal generated by another portion of video controller IC 110. Logical circuit 190 may comprise, for example, a portion of the BIOS setup circuitry of video controller IC 110 which enables various graphics or text modes for video controller IC 110.

Host processor 150 may output a signal to core circuitry 170 to place video controller IC 110 in a particular video mode or pixel resolution and depth. Logical circuitry 190 may compare this mode or resolution and pixel depth to modes and resolutions stored in its internal table and output logic signal 199 indicating which core voltage level is sufficient to support such modes or resolution and pixel depth.

Logic signal 199 may take a low value (logic level 0) if a 5 Volt core voltage is required and a high value (logic level 1) is a 3.3 core voltage is sufficient. Logic signal 199 may be fed to power supply switching circuit 200. Power supply switching circuit 200 may comprise, for example, a Siliconix Si9942DY dual-enhancement mode N-channel and P-channel MOSFET manufactured by Siliconix. The Siliconix Si9942DY MOSFET is packaged in a small, 8-pin, surface mount package suitable for use in a video controller board or laptop computer. It has a rated maximum drain current rating of 2 Amperes, more than enough to supply core voltage $V_{DD}$, which typically may draw less than 200 mA.

A one Ohm resistor may be placed between the +5 Volt power supply and switching circuit 200 to limit output current when $CV_{DD}$ is 5 Volts. In addition, a 10 microfarad capacitor (not shown) may be placed at the output of switching circuit 200 (coupled to ground) to insure a steady power supply when core voltage $CV_{DD}$ is switched between 3.3 Volts and 5 Volts. FIG. 3 illustrates a more detailed example of a switching circuit which may be constructed using the Siliconix Si9942DY MOSFET. The illustration of FIG. 3 is in no way intended to limit the scope or application of the present invention and is provided to comply with the requirement of setting forth the best mode contemplated of the present invention.

Other types of switching circuits may be utilized within the spirit and scope of the present invention. In addition, although shown here as a discrete device, switching circuit 200 may be incorporated into video controller IC 110 to reduce part count and save board space.

Logic signal 199 may be applied to both gate inputs of switching circuit 200. If logic signal 199 is low, the N-channel device is turned off and the P-channel device is turned on, thereby supplying +5 VDC as core voltage $CV_{DD}$. If logic signal 199 is high, the N-channel device is turned on and the P-channel device is turned off, thereby supplying +3.3 VDC as core voltage $CV_{DD}$.

Figure 2:
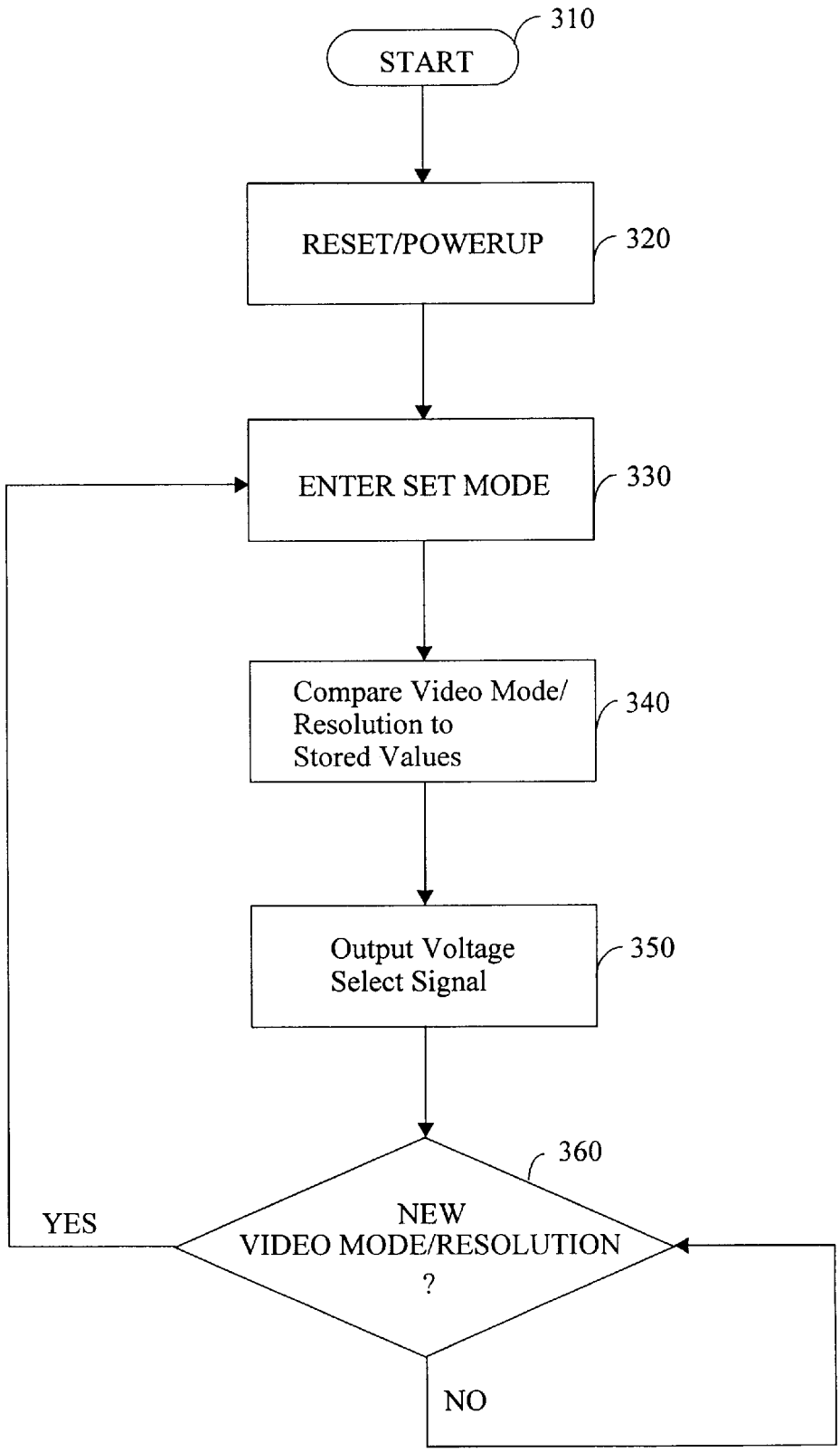
FIG. 2 is a flow chart illustrating the operation of the video controller of FIG. 1.

FIG. 2 illustrates the process steps of video controller IC 110 in generating logic signal 199. START step 310 indicates the beginning of the process. In step 320, host processor 150 is powered up or reset. During the reset process, video controller 110 may be reset and initialized using its internal BIOS program (i.e., VGA BIOS). In step 330, video controller 110 enters SET mode to set the video output mode (i.e., resolution, pixel depth, refresh rate and the like) for video controller 110. The video mode set in step 330 may be a default video mode, or a mode selected by host processor 150.

In step 340, logical circuitry 190 compares the video mode set in step 330 with predetermined stored values to determine what core voltage may be required to support that video mode. In step 350, a register bit representing logical signal 199 is set within logical circuitry 190. This register bit value may be output to external switching circuitry 200 to select a core supply voltage $CV_{DD}$. In step 360 a determination is made whether a new video mode has been selected. If the video mode remains the same, logic signal 199 remains in the same state. If the video mode is altered, processing returns to step 330.

Thus, only the minimum voltage necessary to operate video controller IC 110 is provided to core circuitry 170 at any given time. As host processor 150 switches between different video modes or pixel resolutions and depths, video controller IC 110 may be switched to an appropriate power supply level in order to minimize power consumption whenever possible.

For lower resolutions and pixel depths, core circuitry 170 may operate at a lower supply voltage (e.g., 3.3 Volts) whereas output circuitry may operate at a fixed supply voltage. Output circuitry 180 may output different voltage levels for different types of video displays. For example, for a CRT or a 5 Volt panel, output circuitry 180 may output a 0–5 Volt signal. For other types of flat panel displays, a 0 to 3.3 Volt signal may be output. In general, however, the operating voltage of output circuitry 180 may be fixed for a given display type.

It should be noted that the present invention is intended for use in a integrated circuit constructed using a technology which may operate at multiple supply voltages (e.g., CMOS technology). Moreover, such a technology may be limited to operating at slower clock speed at lower voltages. Since lower clock speed may limit performance, the present invention allows an integrated circuit to operate a these lower supply voltages (and lower clock speeds) when permissible, switching to higher voltages when performance requirements dictate the need for higher clock speeds.

As the core circuitry 170 and output circuitry 180 may operate at different logic levels, it may be necessary to convert logic level signals output from core circuitry 170 to logic levels which may be interpreted by output circuitry 180. Such techniques are known in the art and are disclosed, for example in U.S. Pat. No. 5,300,835, issued Apr. 5, 1994, entitled "CMOS LOW POWER MIXED VOLTAGE BIDIRECTIONAL I/O BUFFER" and incorporated herein by reference.

While the preferred embodiment and various alternative embodiments of the invention have been disclosed and described in detail herein, it may be apparent to those skilled in the art that various changes in form and detail may be made therein without departing from the spirit and scope thereof.

For example, while disclosed herein as applied to a video controller, the present invention may be similarly applied to other types of logical circuitry where low power consumption may be desirable, but where higher voltages may be sometimes required to meet performance requirements.

Moreover, while illustrated here with only two supply voltage levels (i.e., 3.3 Volts and 5 Volts), other numbers and values may be used. For example, three supply voltage levels may be provided to operate an integrated circuit at up to three voltage levels and corresponding maximum operating speeds. Similarly, a continuously variable voltage may be applied to operate an integrated circuit at an absolute minimum voltage required.

Although illustrated here as determining minimum operating voltage by comparing operating modes with a predetermined schedule, other techniques may be utilized. For example, actual operation of the integrated circuit may be monitored to determine whether the integrated circuit is operating at a speed sufficient for the task assigned to it. If the circuit shows signs of malfunctioning (i.e., operating too slowly for conditions), the supply voltage may be increased accordingly.

What is claimed is:

1. A video controller integrated circuit constructed from an integrated circuit technology which may operate at multiple operating voltages, the video controller integrated circuit coupling to a switching circuitry for selectively supplying one of the multiple operating voltages to the video controller integrated circuit, the video controller circuit generally operating slower at lower operating voltages, said video controller integrated circuit comprising:

a core circuitry for receiving video data from a video memory and processing the video data to produce video output data and for receiving a signal indicative of at least a resolution and a pixel depth for the video data, said core circuitry receiving a selected power supply voltage from the switching circuit;

an output circuitry, coupled to said core circuitry, for receiving the video output data and generating a video output signal, said output circuitry receiving the selected power supply voltage from the switching circuit;

a logic circuitry, coupled to said core circuitry, for receiving the signal indicative of at least a resolution and a pixel depth and outputting a logic level signal to the switching circuit indicative of a supply voltage sufficient to drive said core circuitry at the resolution and the pixel depth, wherein the switching circuitry is switched to output a minimum selected power supply voltage from the multiple operating voltages which will operate the video controller integrated circuit at the resolution and pixel depth indicated by the signal indicating the resolution and pixel depth.

2. A method of controlling a power supply to an integrated circuit comprising the steps of:

monitoring, in the integrated circuit, a performance level of the integrated circuit;

determining, in the integrated circuit, a minimum supply voltage for operating the integrated circuit at the monitored performance level;

outputting a logic level signal to a switching device indicative of a minimum supply voltage for operating the integrated circuit at the monitored performance level; and switching, in a switching circuit, a power supply voltage in response to the logic level signal so as to provide a minimum supply voltage for operating the integrated circuit at the monitored performance level.

3. The method of claim 2, further comprising the step of:

converting output signals of the integrated circuit to a voltage level corresponding to a predetermined supply voltage.

4. An electrical circuit comprising:

circuitry for performing at least one predetermined function;

logic, coupled to said circuitry, for monitoring performance of said circuitry and outputting a logic signal indicative of a minimum supply voltage for operating the circuitry at a monitored performance level, wherein said logic monitors a mode of operation of said circuitry and outputs a logic signal indicative of a minimum supply voltage from a range of supply voltages, required to operating the circuitry in the monitored mode of operation; and switching means, coupled to the circuitry and the logic, for supplying a supply voltage sufficient to operate the circuitry at the monitored performance level in response to the logic signal generated by the logic.

5. The electrical circuit of claim 4 wherein said electrical circuit comprises a video controller and said circuitry for performing at least one predetermined function comprises a digital circuit for processing video data and wherein said logic monitors a video mode and pixel resolution operation of said circuitry, compares the monitored video mode and pixel resolution to predetermined modes and pixel resolutions and outputs a logic signal indicative of a minimum supply voltage for operating the circuitry in the monitored mode and pixel resolution.

6. The electrical circuit of claim 5, wherein said switching means supplies a supply voltage sufficient to operate the circuitry at the monitored mode and pixel resolution.

7. The electrical circuit of claim 4, wherein said switching means further comprises:

a first power supply having a first predetermined voltage;

a second power supply having a second predetermined voltage; and a switching circuit, coupled to said first power supply, said second power supply, and said logic, for receiving the logic signal and switching said first predetermined voltage and said second predetermined voltage to the circuitry in response to the logic signal.

8. The electrical circuit of claim 7, wherein said first power supply has a first predetermined voltage of substantially 3.3 Volts.

9. The electrical circuit of claim 7 wherein said second power supply has a second predetermined voltage of substantially 5 Volts.

10. An energy saving VGA controller for use in a personal computer system, comprising:

core circuitry comprising logical circuitry and a look-up table for receiving video data in a selected video mode, pixel resolution, pixel depth, and refresh rate from an external video memory and converting the video data in the look-up table into output video data;

analog output circuitry, coupled to the core circuitry, said analog output circuitry comprising an analog to digital converter for converting video output data from the core circuitry into an analog output signal;

a further logic circuit, coupled to the core circuitry, for monitoring the selected video mode, pixel resolution, pixel depth, and refresh rate, and outputting a voltage selection signal indicative of minimum voltage to operate the core circuitry at the selected mode, pixel resolution, pixel depth, and refresh rate; and switching means, coupled to the core circuitry and the further logic circuit, for supplying a supply voltage sufficient to operate the circuitry at the monitored mode and pixel resolution in response to the voltage selection signal, wherein said switching means further comprises:

a first power supply having a first predetermined supply voltage;

a second power supply having a second predetermined supply voltage; and a switching circuit, coupled to said first power supply, said second power supply, and said further logic circuit, for receiving the voltage selection signal and switching said first predetermined voltage and said second predetermined voltage to the circuitry in response to the voltage selection signal.

11. A video controller integrated circuit comprising:

a digital circuit for processing video data;

logic, coupled to said digital circuit, for monitoring video mode and pixel resolution operation of said digital circuit, comparing the monitored video mode and pixel resolution to predetermined modes and pixel resolutions and outputting a logic signal indicative of a minimum supply voltage for operating the digital circuit in the monitored mode and pixel resolution; and switching means, coupled to the circuitry and the logic, for supplying a supply voltage sufficient to operate the circuitry at the monitored mode and pixel resolution, wherein said switching means further comprises:

a first power supply having a first predetermined voltage of substantially 3.3 Volts;

a second power supply having a second predetermined voltage of substantially 5 Volts; and a switching circuit, coupled to said first power supply, said second power supply, and said logic, for receiving the logic signal and switching said first predetermined voltage and said second predetermined voltage to the circuitry in response to the logic signal.

* * * * *